United States Patent [19]

Shiina

[11] Patent Number: 4,867,806

[45] Date of Patent: Sep. 19, 1989

[54] HEAT-RESISTING HIGH-STRENGTH AL-ALLOY AND METHOD FOR MANUFACTURING A STRUCTURAL MEMBER MADE OF THE SAME ALLOY

[75] Inventor: Haruo Shiina, Shiki, Japan

[73] Assignee: Honda Giken Kogyo Kabushiki Kaisha, Tokyo, Japan

[21] Appl. No.: 206,931

[22] Filed: May 31, 1988

Related U.S. Application Data

[63] Continuation of Ser. No. 801,719, Nov. 26, 1985, abandoned.

[30] Foreign Application Priority Data

Nov. 28, 1984 [JP] Japan ..... 59-249472
Apr. 17, 1985 [JP] Japan ..... 60-81938

[51] Int. Cl.[4] ..... C22F 1/04

[52] U.S. Cl. ..... 148/11.5 P; 75/249; 148/11.5 A; 148/439; 419/30; 419/41; 419/48; 419/66; 419/67

[58] Field of Search ..... 420/532; 75/249; 148/11.5 A, 11.5 P, 439; 419/30, 41, 48, 66, 67

[56] References Cited

U.S. PATENT DOCUMENTS 2,357,449 9/1944 Bonsack .
3,325,279 6/1967 Lawrence et al. .
4,435,213 3/1984 Hildeman et al. ..... 148/11.5 P

FOREIGN PATENT DOCUMENTS 0112787 7/1984 European Pat. Off. .
0144898 6/1985 European Pat. Off. .
469954 8/1937 United Kingdom .
469955 8/1937 United Kingdom .
563616 8/1944 United Kingdom .
563617 8/1944 United Kingdom .
563994 9/1944 United Kingdom .

*Primary Examiner*—R. Dean
*Attorney, Agent, or Firm*—Armstrong, Nikaido, Marmelstein, Kubovcik & Murray

[57] ABSTRACT

Al-alloy containing Si, Fe, Cu and Mg and at least one kind of Mn and Co in the basic composition range of $8.0 \leqq Si \leqq 30.0$ wt. %, $2.0 \leqq Fe \leqq 33.0$ wt. %, $0.8 \leqq Cu \leqq 7.5$ wt. %, $0.3 \leqq Mg \leqq 3.5$ wt. %, $0.5 \leqq Mn \leqq 5.0$ wt. % and $0.5 \leqq Co \leqq 3.0$ wt. %, are provided in a powder state. A sindered member formed of these Al-alloys has a high strength and reveals excellent heat-resistivity and stress corrosion cracking resistivity. A structural member made of the sintered all-alloy is manufactured through the steps of subjecting a powder press-shaped body formed at a temperature of 350° C. or lower and at a pressure of 1.5~5.0 ton/cm$^2$ to hot extrusion working at a temperature of 300°~400° C. to form a raw material for forging, and then forge shaping the raw material at a temperature of 300°~495° C.

5 Claims, No Drawings

HEAT-RESISTING HIGH-STRENGTH AL-ALLOY AND METHOD FOR MANUFACTURING A STRUCTURAL MEMBER MADE OF THE SAME ALLOY

This application is a continuation of application Ser. No. 801,719 filed Nov. 26, 1985 abandoned.

BACKGROUND OF THE INVENTION

The present invention relates to a heat-resisting high-strength Al-alloy that is excellent in heat-resistivity, hot-forgeability and stress-corrosion-cracking resistivity, and a method for manufacturing a structural member made of the same Al-alloy (for example, a piston for an internal combustion engine, a connecting rod, etc.) through a powder metallurgical process.

In an internal combustion engine for motor vehicles, in order to realize reduction of weight of a vehicle body, aluminium-alloy materials have been positively employed, and especially it is effective also for reducing an inertial force to form moving parts such as connecting rods, pistons or the like of aluminium-alloy materials. Such moving parts are required to have heat-resistivity and high strength because they are used under a severe condition at a high temperature, and in order to fulfil this requirement, there is a tendency of employing powder metallurgical products in which alloy elements can be added with a large freedom.

The inventor of this invention proposed previously jointly with two other co-inventors Al-alloy for powder metallurgical products in which high proportions of Si, Fe and other elements were added to Al aiming at improvements in a high-temperature strength, a Young's modulus, an abrasion-proofness and a heat-resistivity (See Japanese patent application No. 59-166979).

However, as a result of various subsequent investigations on the above-proposed Al-alloy containing Fe in the proportion range of $2.0 \leqq Fe \leqq 10$ wt.%, it was seen that especially in the proportion range of $Fe \geqq 6$ wt.% it was necessary to make further improvements in hot-forging workability of a raw material for forging (in the form of a preshaped product), stress corrosion cracking resistivity of a finally shaped product, a density of a structural member and a strength of a structural member at 150°~200° C.

More particularly, if the above-mentioned raw material for forging ($Fe \geqq 6$ wt.%) is subjected to high-speed hot-forging work (working speed=75 mm/sec or higher) that is equal to that in the case of duralumin, defects such as cracking or the like are liable to occur therein. Therefore, in order to improve the hot forging workability, various counter-measures in the forging process such as lowering of a working speed, raising of a metal mold temperature and the like have to be taken, hence a mess-productivity is degraded, and a manufacturing cost of parts would become high.

In addition, in the proportion range of $Fe < 6$ wt.%, although the structural member formed of the finally shaped product has a high strength as compared to that made of publicly known alloys (JIS AC8A, AC8B and AC8C: See Table-1) at a temperature in the proximity of 300° C., at a temperature of 150°~200° C. further improvements in a strength are desired.

TABLE 1

| | (JIS H5202-1971: Al-alloys for metal-mold, sand-mold and shell castings) | | | | | | | | | |
|---|---|---|---|---|---|---|---|---|---|---|
| | Chemical Composition (wt. %) | | | | | | | | | Names of |
| Symbols | Cu | Si | Mg | Zn | Fe | Mn | Ni | Ti | Al | Corresponding Alloys |
| AC8A | 0.8~1.3 | 11.0~13.0 | 0.7~1.3 | <0.1 | <0.8 | <0.1 | 1.0~2.5 | <0.2 | " | AAA 332.0 Lo-ex |
| AC8B | 2.0~4.0 | 8.5~10.5 | 0.5~1.5 | <0.5 | <1.0 | <0.5 | 0.5~1.5 | <0.2 | " | Lo-ex |
| AC8C | 2.0~4.0 | 8.5~10.5 | 0.5~1.5 | <0.5 | <1.0 | <0.5 | — | <0.2 | " | AAF 332.0 |

Furthermore, in the case where a connecting rod is formed of the above-proposed Al-alloy, there is a fear that stress corrosion cracking (according to the JIS stress corrosion cracking test) may arise at the locations where stress is continuously applied such as a pin-boss section (a smaller end portion) or a bearing-cap fastening section (a larger end portion) of a connecting rod, and this becomes a principal cause of lowering of durabilities of component parts in an engine in association with the trend of speed-up of an engine in the recent years.

Besides, since the above-proposed Al-alloy has a high density as compared to that of known alloys, the Al-alloy imposes a disadvantageous condition upon realization of light weight of a structural member.

SUMMARY OF THE INVETION

It is therefore a principal object of the present invention to provide heat-resisting high-strength Al-alloy, whose intermediate raw material can be subjected to high-speed hot forging work and thereby a structural member having a high strength at a temperature of 150°~200° C. in which stress corrosion cracking would hardly occur, can be obtained, and whose density is close to that of known alloys.

Another object of the present invention is to manufacture a structural member made of heat-resisting high-strength sintered Al-alloy by making use of the aforementioned Al-alloy.

The above-described principal object of the present invention can be achieved by providing Al-alloy containing Si, Fe, Cu and Mg in the proportion ranges of: $8.0 \leqq Si \leqq 30.0$ wt.%, $2.0 \leqq Fe \leqq 33.0$ wt.%, $0.8 \leqq Cu \leqq 7.5$ wt.%, and $0.3 \leqq Mg \leqq 3.5$ wt.%, and at least one of Mn and Co in the proportion ranges of: $0.5 \leqq Mn \leqq 5.0$ wt.% and $0.5 \leqq Co \leqq 3.0$ wt.%.

According to another feature of the present invention, the structural member made of the above-featured Al-alloy can be obtained through a method of manufacture consisting of:

a powder making step in which molten Al-alloy is quenched and solidified at a cooling speed of $10^{3}$° C./sec. or higher to obtain powder;

a powder pressing step in which said Al-alloy powder is press-shaped at a temperature of 350° C. or lower and at a shaping pressure of 1.5~5.0 ton/cm$^2$ to obtain a raw material for extrusion having a density ratio of 70% or higher;

an extrusion step in which said raw material for extrusion is subjected to hot extrusion at a temperature of 300°~400° C. to obtain a raw material for forging; and a forging step in which after said raw material for forging has been forge-shaped at a temperature of 300°~495° C. by making use of a metal mold that was preliminarily heated up to a temperature of 150° C. or higher, the forge-shaped body is cooled.

DETAILED DESCRIPTION OF THE INVENTION

If Fe and Si are added into Al, improvements in a high-temperature strength and a Young's modulus can be achieved, but intermetallic compounds such as $Al_3Fe$, $Al_{12}Fe_3Si$, etc. in an acicular shape would precipitate, resulting in deterioration of hot forging workability, sintering property, stress corrosion cracking resistivity, etc. Therefore, it becomes an effective measure that enhancement of heat treatment of an Al-matrix is contemplated to reduce the amount of Fe by adding Cu, Mg or Co, and thereby hot forging workability and sintering property are improved.

In addition, it is possible to supress generation of acicular crystals for enhancing hot forging workability and also improving stress corrosion cracking resistivity by adding Mn, to promote age hardening phenomena by adding Zn, and to suppress rise of an alloy density by adding Li.

In the Al-alloy according to the present invention, the respective alloying elements are added in the following chemical composition ranges:

$$8.0 \leqq Si \leqq 30.0 \text{ wt.\%} \quad \text{(a)}$$

Si is an essential component. Si contributes to enhancement of an abrasion-proofness and a Young's modulus, suppresses a coefficient of thermal expansion to a low value, and can enhance a thermal conductivity. If the amount of addition of Si is less than 8.0 wt.%, such effects cannot be achieved, while if it exceeds 30 wt.%, workability is deteriorated upon extrusion working as well as upon forge working, and so, cracks are liable to occur in a shaped article.

$$2.0 \leqq Fe \leqq 33.0 \text{ wt.\%} \quad \text{(b)}$$

Fe is an essential component and it is added for the purpose of enhancing a high-temperature strength and a Young's modulus. If the amount of addition of Fe is less than 2.0 wt.%, enhancement of a high-temperature strength cannot be expected, while if it exceeds 33.0 wt.%, a density increases, resulting in fail in reduction of weight, and moreover, workability upon performing hot extrusion work and hot forging work is deteriorated. In addition, although a Young's modulus is enhanced in accordance with increase of the amount of addition of Fe, if the increase of a density is taken into consideration, the amount of addition of Fe should be limited to the upper limit of 33.0 wt.%.

$$0.8 \leqq Cu \leqq 7.5 \text{ wt.\%} \quad \text{(c)}$$

Cu is an essential component, and it is added for the purpose of compensating for deterioration of sintering property and hot forging workability caused by addition of Fe and Si. Also, by the addition of Cu, a heat treatment strength of an Al matrix can be enhanced. If the amount of addition of Cu is less than 0.8 wt.%, such effects cannot be obtained, while if it exceeds 7.5 wt.%, it will result in deterioration of stress corrosion cracking resistivity and lowering of hot forging workability, and a high-temperature strength of a finally shaped article would be degraded.

$$0.3 \leqq Mg \leqq 3.5 \text{ wt.\%} \quad \text{(d)}$$

Mg is an essential component, and it functions similarly to Cu in that it can enhance a strength of an Al matrix through heat treatment. If the amount of addition of Mg is less than 0.3 wt.%, the effect of addition is not present, while if it exceeds 3.5 wt.%, stress corrosion cracking resistivity is deteriorated and hot forging workability is lowered.

$$0.5 \leqq Mn \leqq 5.0 \text{ wt.\%} \quad \text{(e)}$$

Mn and Co are such elements that either one or both of them are necessarily added.

In preparation of atomized powder, although it is necessary to set a cooling speed of aluminium-alloy powder at the maximum, if mass-productivity is taken into consideration, then a cooling speed of $10^3 \sim 10^{5}$° C./sec is the limit. In this range of the cooling speed, at an Fe content of $Fe \leqq 6$ wt.%, owing to the fact that Al-Fe-Si series intermetallic compounds can be fully severed in the step of hot extrusion working and also the state of precipitation of the compounds is granular, high-speed hot forging to a certain extent is possible. On the other hand, at an Fe content of $Fe > 6.0$ wt.%, the state of precipitation of the above-referred intermetallic compounds becomes acicular, a hot deformation resistance increases, and so, high-speed hot forge working becomes impossible.

Mn is effective for controlling the state of precipitation of the above-referred intermetallic compounds. More particularly, by adding the above-mentioned particular amount of Mn, in place of acicular $Al_3Fe$ phase and $\beta$-$Al_5FeSi$ phase, granular $Al_6(Fe, Mn)$ phase and $\alpha$-$Al_{12}(Fe, Mn)_3Si$ phase are preferentially precipitated, thereby high-speed hot forging workability is improved, and thus a strength of a structural member can be enhanced.

In the above-mentioned range of the amount of addition, Mn improves a high-temperature strength of Al-alloy containing Fe, especially in the amount of $Fe \geqq 4.0$ wt.%, and contributes to enhancement of hot forging workability and improvement in stress corrosion cracking resistivity. However, if it exceeds 5.0 wt.%, on the contrary the hot forging workability is lowered and there occurs an adverse effect.

$$0.5 \leqq Co \leqq 3.0 \text{ wt.\%} \quad \text{(f)}$$

Co is added necessarily, as described previously, jointly with Mn or in place of Mn. Co is effective for improving a high-temperature strength in the case where an Fe content is reduced for the purpose of improving forging workability, it can enhance a tensile strength, a proof stress and a fatigue strength without deteriorating elongation property, and it can enhance a high-temperature strength without degrading stress corrosion cracking resistivity and forging workability. However, if the amount of addition is less than 0.5 wt.%, the effect is little, while if it exceeds 3.0 wt.%, the effect of improvement is not so remarkable as the increase of the amount of addition, and moreover from the reason that Co is expensive also, it is limited to 3.0 wt.% or less.

$0.5 \leqq Zn \leqq 10.0$ wt.% (g)

Zn is an element that can be selectively added. In order to enhance a strength of a member to be used under a temperature condition of 200° C. or lower, it is effective to subject the member to a T6 treatment (artificial aging hardening treatment after solution heat treatment) and utilize a hardening phenomenon caused by precipitation of intermetallic compounds produced by addition of Si, Cu and Mg, and Zn has a function of promoting the aging precipitation. However, if the amount of addition is less than 0.5 wt.%, the above-mentioned effect cannot be attained, while if it exceeds 10.0 wt.%, a hot deformation resistance increases, and hence, high-speed hot forging work becomes difficult.

Heretofore, in the case of adding Zn as an effective element, Si contained in the Al-alloy was dealt with as an impurity, but in the case of the structural member according to the present invention, upon manufacturing the structural member Zn and Si are positively made to coexist by employing a powder metallurgical process to realize enhancement of an abrasion-proofness and lowering of a coefficient of thermal expansion caused by proeutectic Si, also a hardening phenomenon caused be precipitation of Zn compounds is utilized, and thereby it is possible to enhance a strength of the material.

In this way, by adding Zn, a strength of a structural member after a T6 treatment can be enhanced, so that it is possible to reduce a density of a structural member by suppressing an amount of addition of Fe and also to improve hot forging workability.

$1.0 \leqq Li \leqq 5.0$ wt.% (h)

Li is an element that can be selectively added. It is used for the purpose of suppressing rise of an alloy density caused by addition of Fe, and the suppressing effect is enhanced in accordance with increase of the amount of addition of Li. In addition, Li also has an effect of enhancing a Young's modulus and giving a high rigidity. If the amount of addition of Li is less than 1.0 wt.%, the effect of suppressing rise of a density is little, while if it exceeds 5.0 wt.%, there arises a problem that the manufacturing process becomes complexed because Li is active.

[EXAMPLES OF COMPOSITION]

Now description will be made on a number of preferred examples of the composition of the aluminium alloy according to the present invention.

(1) $15 \leqq Si \leqq 18$ wt.%, $4 \leqq Fe \leqq 6$ wt.%, $4 \leqq Cu \leqq 5$ wt.%, $1 \leqq Mg \leqq 2$ wt.%, and $1 \leqq Co \leqq 2$ wt.%:

In this first preferred embodiment, the Fe content is suppressed to 6 wt.% or less to realize lowering of a density and to assure forging workability, the Co conftent is held at 1~2 wt.% where the workability is not adversely affected, to supplement a high-temperature strength in the case where the amount of addition of Fe is reduced, Cu and Mg are defined within the optimum range for aiming at improvement of sintering property and heat treatment effects, and Si is defined within the optimum range for obtaining satisfactory abrasion-proofness, Young's modulus and machinability.

(2) $15 \leqq Si \leqq 18$ wt.%, $4 \leqq Fe \leqq 8$ wt.%, $4 \leqq Cu \leqq 5$ wt.%, $1 \leqq Mg \leqq 2$ wt.%, $0.5 \leqq Co \leqq 1.5$ wt.%, and $1.5 \leqq Mn \leqq 2.5$ wt.%:

In this composition range, Mn can improve deterioration of shapability associated with increase of Fe and also can enhance a strength of a structural member. Since there is no need to reduce the amount of Fe owing to addition of Mn, even if the amount of Co is suppressed, a more excellent high-temperature strength can be obgained as compared to the alloy composition of the above-described first example (1).

(3) $15 \leqq Si \leqq 18$ wt.%, $4 \leqq Fe \leqq 8$ wt.%, $4 \leqq Cu \leqq 5$ wt.%, $1 \leqq Mg \leqq 2$ wt.%, $0.5 \leqq Co \leqq 1.5$ wt.%, and $2.0 \leqq Zn \leqq 4.0$ wt.%:

In this composition range, Zn can enhance a strength at 150°~200° C. by carrying out heat treatment (T6 or T7 treatment).

(4) $15 \leqq Si \leqq 18$ wt.%, $4 \leqq Fe \leqq 8$ wt.%, $4 \leqq Cu \leqq 5$ wt.%, $1 \leqq Mg \leqq 2$ wt.%, $0.5 \leqq Co \leqq 1.5$ wt.%, and $2 \leqq Li \leqq 4$ wt.%:

In this composition range, Li is effective for suppressing rise of a density of the alloy associated with addition of Fe.

(5) $15 \leqq Si \leqq 18$ wt.%, $4 \leqq Fe \leqq 8$ wt.%, $4 \leqq Cu \leqq 5$ wt.%, $1 \leqq Mg \leqq 2$ wt.%, $0.5 \leqq Co \leqq 1.5$ wt.%, $1.5 \leqq Mn \leqq 2.5$ wt.%, $2.0 \leqq Zn \leqq 4.0$ wt.%, and $2 \leqq Li \leqq 4$ wt.%:

The alloys falling in this composition range, are excellent in a high-temperature strength, a strength at 150°~200° C., and forging workability, and relatively light in weight (has a low density).

(6) $14 \leqq Si \leqq 18$ wt.%, $3.0 \leqq Fe \leqq 5.0$ wt.%, $2.0 \leqq Cu \leqq 5.0$ wt.%, $0.3 \leqq Mg \leqq 1.5$ wt.%, and $0.5 \leqq Mn \leqq 2.5$ wt.%:

According to this embodiment, by suppressing Fe to 5.0 wt.% or less, stress corrosion craking resistivity is improved and good hot forging workability is assured, and also by adding Mn a high-temperature strength is improved. In addition, Cu and Mg are effective for improvement in a strength of an Al matrix through heat treatment, and the alloy is useful for forming a member to be used at an environmental temperature of about 150° C.

(7) $14 \leqq Si \leqq 18$ wt.%, $3.0 \leqq Fe \leqq 5.0$ wt.%, $2.0 \leqq Cu \leqq 5.0$ wt.%, $0.3 \leqq Mg \leqq 1.5$ wt.%, $0.5 \leqq Mn \leqq 2.5$ wt.%, and $1.0 \leqq Co \leqq 2.0$ wt.%:

Co in the above-mentioned composition range is effective for improving a high-temperature strength in the case where the amount of addition of Fe is suppressed to within the range where Fe does not adversely affect stress corrosion cracking resistivity and shapability.

(8) $14 \leqq Si \leqq 18$ wt.%, $3.0 \leqq Fe \leqq 5.0$ wt.%, $2.0 \leqq Cu \leqq 5.0$ wt.%, $0.3 \leqq Mg \leqq 1.5$ wt.%, $0.5 \leqq Mn \leqq 2.5$ wt.%, and $2.0 \leqq L \leqq 4.0$ wt.%:

Li in the above-referred composition range can suppress rise of an alloy density caused by addition of Fe.

(9) $14 \leqq Si \leqq 18$ wt.%, $3.0 \leqq Fe \leqq 5.0$ wt.%, $2.0 \leqq Cu \leqq 5.0$ wt.%, $0.3 \leqq Mg \leqq 1.5$ wt.%, $0.5 \leqq Mn \leqq 2.5$ wt.%, and $2.0 \leqq Zn \leqq 4.0$ wt.%:

Zn in the above-referred composition range can enhance a strength at 200° C. or lower through heat treatment.

In order to obtain a structural member made of sintered Al-alloy having the above-referred composition, a method of manufacture consisting of the following respective steps, is employed:

(1) Powder Making Step:

Alloy powder is obtained from molten Al-alloy having a desired composition through, for exmple, an atomizing process. During that process, if a cooling speed of molten metal is lower than $10^{3}$° C./sec, then intermetallic compounds such as $Al_3Fe$, $Al_{12}FeSi$, $Al_9Fe_2Si$, etc. would precipitate in a coarse granular state, and this causes lowering of a strength of the product structural member. The sizes of the precipitates should be preferably 10 μm or less, and a molten metal cooling speed serving as a measure for obtaining such sizes is $10^{3°}$ C./sec. If the sizes of the precipitates exceed 10 μm, then enhancement of a fatigue strength can be hardly expected, and also there is a disadvantage that shapability is degraded.

(2) Powder Pressing Step:

Within the atmosphere, shaping is effected at a shaping temperature of 350° C. or lower and at a shaping pressure of 1.5~5.0 ton/cm$^2$, and thereby a pressed powder body having a density ratio of 70% or higher is obtained. The reason is because if the shaping temperature exceeds 350° C., then oxidation of powder surfaces would proceed and hence sintering property in the subsequent extrusion step is deteriorated. In order to prevent oxidation it is only necessary to select an inert gas atmosphere, but since productivity and economy are lowered thereby, shaping within the atmosphere is recommended. In addition, if the shaping pressure is less than 1.5 ton/cm$^2$, it is difficult to handle the pressed powder body so as not to damage it, and hence mass-productivity is lost, while if it exceeds 5.0 ton/cm$^2$, a life of a metal mold is shortened, and so, there is a disadvantage that an installation becomes large-sized and mass-productivity is lost. A density ratio is determined depending upon a shaping pressure, and if this ratio is lower than 70%, handling of the pressed powder body becomes difficult, resulting in lowering of productivity, and this becomes a principal cause of lowering of a strength of the product, structural member. On the other hand, if the shapability in the subsequent steps (principally the extrusion step) is taken into consideration, it is preferable to keep the density ratio at 85% or lower.

(3) Extrusion Step:

The pressed powder body prepared as a raw material for extrusion is subjected to extrusion working at a temperature range of 300°~400° C. If the working temperature is lower than 300° C., then a deformation resistance of the raw material is large, hence the working becomes difficult, and especially if the amount of Fe in the raw material increases, then a hardness of the powder rises and sintering property is deteriorated, and therefore, working should be carried out at a temperature of 300° C. or higher. On the other hand, if the working temperature exceeds 400° C., then crystal grains and intermetallic compounds would grow, resulting in coarse grains, and so, mechanical properties required for the product, structural member cannot be obtained. Especially, if the amount of additive elements is increased, a eutectic temperature is lowered and burning is liable to occur, resulting in deterroration of the sintering property, and therefore, the working must be carried out at a temperature of 400° C. or lower.

It is to be noted that if prevention of oxidation of a shaped article is taken into consideration, it is preferable to perform the working within a nonoxidizing atmosphere such as an argon gas, a nitrogen gas, etc.

(4) Forging Step:

After forging work has been carried out at a temperature range of 300°~495° C. by making use of a forging metal mold that was preliminarily heated up to 150° C. or higher, the worked body is cooled. If the metal mold temperature is lower than 150° C., when the raw material for forging that was obtained by the extrusion work is charged in the metal mold, the surface temperature of that raw material is lowered abruptly, hence cracks are liable to be generated upon the forging work, and a yield would be lowered. However, if the metal mold temperature exceeds 450° C., lubrication of the metal mold becomes difficult, hence the life of the mold is shortened, and thus mass-productivity is lost.

In addition, if the forging work temperature is lower than 300° C., then a deformation resistance increases, resulting in deterioration of forging workability, while if it exceeds 495° C., mechanical propertie of the product are deteriorated. The cooling after the forging work could be either air-cooling or water-cooling.

[Test Example I]

First Step: The respective Al-alloy powders having the compositions shown in Table-2 are made at a cooling speed of $10^{4°}$~$10^{5°}$ C./sec through an atomizing process (contrast examples a, b and c: examples according to the present invention A, B, . . . , G), and starting from the respective alloy powders, raw materials for extrusion having a density ratio of 75%, a diameter of 225 mm and a length of 300 mm are shaped by pressing the powders through a cold isostatic pressing process (CIP process) or a metal mold compression shaping process.

In the cold isostatic pressing process, the alloy powder is charged in a tube made of rubber, and shaping is carried out under an isostatic pressure of about 1.5~3.0 ton/cm$^2$, while in the metal mold compression shaping process, the alloy powder is charged in a metal mold, and shaping is carried out at a room temperature within the atmosphere under a pressure of about 1.5~3.0 ton/cm$^2$.

Second Step: The respective raw materials for extrusion are placed within a soaking pit having a furnace temperature of 350° C. and held for 10 hours, subsequently the respective raw materials for extrusion are subjected to hot extrusion working, and thereby raw materials for forging are prepared.

The method of extrusion in this case could be either direct extrusion (forward extrusion) or indirect extrusion (backward extrusion), but an extrusion ratio of 5 or higher is necessitated. If the extrusion ratio is lower than 5, distribution of strengths becomes large, and so, it is not favorable. The temperature of the raw material for extrusion working is set at 300°~400° C. If it is lower than 300° C., a deformation resistance of the raw material becomes large and hence extrusion workability is deteriorated, while if it exceeds 400° C., then coarsening of a metallurgical structure would occur, and hence high strength products cannot be obtained. After the extrusion working the raw material for forging work is cooled at a predetermined cooling speed either by air-cooling or by water-cooling.

Third Step: Thereafter, the respective raw-materials for forging were heated up to 460°~470° C., and they were subjected to high-speed hot forging work at a working speed of 75 mm/sec (nearly the same working speed as that of forging work for duralumine) by means of a crank press.

The thus obtained respective forge-shaped articles were subjected to artificial age hardening treatment subsequent to solution heat treatment (T6 treatment), then, tension test pieces having a parallel portion diamete of 3 mmϕ and a parallel portion length of 25 mm were cut out, and after the tension test pieces were held at 200° C. for 48 hours, tension tests were conducted at the same temperature. In addition, plate-shaped test pieces of 80 mm in length, 10 mm in width and 2 mm in thickness were cut out of forge-shaped articles after the artificial age hardening treatment subsequent to solution heat treatment (T6 treatment), according to JIS H8711 was carried out, and after the test pieces were left for 28 days in an aqueous solution of NaCl having a concentration of 3.5% at a liquid temperature of 30° C. setting a load stress at $\sigma_{0.2}\times 0.9$ (where $\sigma_{0.2}$ represents 0.2% proof stress value of each alloy A~G, a~c), existence or non-existence of generation of crackings was confirmed. The test results are as shown in Table-3. here, it is to be noted that with respect to samples a and F, a density was measured and the results of measurement are also indicated in Table-3.

TABLE 2

| | | Chemical Composition (wt. %) | | | | | | | |
|---|---|---|---|---|---|---|---|---|---|
| | | Si | Fe | Cu | Mg | Mn | Zn | Li | Co |
| Examples | A | 17.2 | 4.3 | 4.5 | 1.2 | 1.8 | — | — | — |
| According to | B | 17.9 | 4.3 | 2.5 | 0.5 | 1.8 | — | — | — |
| the Present | C | 17.2 | 4.2 | 4.5 | 1.0 | 0.8 | — | — | — |
| Invention | D | 17.2 | 4.2 | 2.5 | 0.5 | 0.8 | — | — | — |
| | E | 17.6 | 4.0 | 2.5 | 0.5 | 1.0 | — | — | 1.5 |
| | F | 17.2 | 4.3 | 4.5 | 1.2 | 1.8 | — | 2.5 | — |
| | G | 17.2 | 4.2 | 2.5 | 0.5 | 0.8 | 2.5 | — | — |
| Contrast | a | 17.8 | 4.8 | 4.1 | 0.8 | — | — | — | — |
| Examples | b | 17.1 | 7.6 | 4.2 | 1.8 | — | — | — | — |
| | c | 17.0 | 0.3 | 4.5 | 0.5 | — | — | — | — |

TABLE 3

| | | Tensile Strength at 200° C. (Kg/mm²) | Stress Corrossion Cracking Test (According to JIS H8711) Existence or Non-Existence of Cracks | Heat Treatment | Density (gr/cm³) |
|---|---|---|---|---|---|
| Examples | A | 27.0 | Non-Existence | T6 | — |
| According to | 26.5 | Non-Existence | T6 | — | |
| B | | | | | |
| the present | C | 26.5 | Non-Existence | T6 | — |
| Invention | D | 25.0 | Non-Existence | T6 | — |
| | E | 28.5 | Non-Existence | T6 | — |
| | F | 27.0 | Non-Existence | T6 | 2.75 |
| | G | 26.5 | Non-Existence | T6 | — |
| Contrast | a | 25.0 | Existence | T6 | 2.83 |
| Examples | b | 30.5 | Existence | T6 | — |
| | c | 16.0 | Non-Existence | T6 | — |

As will be apparent from Table-3, for all of the examples according to the present invention A~G, stress corrosion crackings are not generated, and moreover, a tensile strength at 200° C. is excellent. Whereas, in the case of the contrast examples a and b not containing Mn, stress corrosion cracking is generated, and with respect to the contrast example c, though Mn is not contained, owing to the fact that the content of Fe is 0.3 wt.%, stress corrosion crackings are not generated, and due to lack of the Fe content a tensile strength at 200° C. is poor.

[Test Example II]

First Step: Starting from the respective Al-alloy powders having the compositions shown in Table-4 (contrast examples a, b and c; examples according to the present invention H,I,J,K and L), raw materials for extrusion working are made through a similar method to the case of the test example I, and raw materials for extrusion working having a density ratio of 75%, a diameter of 225 mm and length of 300 mm are shaped by pressing the powders through a cold isostatic pressing process (C.I.P. process) or a metal mold copression shaping process.

Second Step: The respective raw materials for extrusion working are placed within a soaking pit having a furnace temperature of 350° C. and held for 10 hours, and subsequently, the respective raw materials for extrusion working are subjected to hot extrusion working to prepare raw materials for forge working.

Third Step: Thereafter, the respective raw materials for forging were heated up to 460°~470° C., and they were subjected to high-speed hot forging work at a working speed of 75 mm/sec by means of a crank pulse.

With respect to the respective forge-shaped articles obtained in the above-described manner, existence or non-existence of cracks caused by forging, and hardness after air-cooling were checked, and artificial age hardening treatment subsequent to solution heat treatment (T6 treatment) was carried out, thereafter the test pieces were exposed to a high temperature under the conditions of 200° C.×48 hours and 300° C.×48 hours, and the residual hardness was measured at a room temperature. In addition, with respect to the test pieces d, K and L, a density was measured and these results of measurement ae shown in Table 5.

TABLE 4

| | | Additive Elements (wt. %) | | | | | | | |
|---|---|---|---|---|---|---|---|---|---|
| | | Si | Fe | Cu | Mg | Co | Mn | Zn | Li |
| Examples | H | 17.8 | 4.8 | 4.1 | 1.2 | 1.6 | — | — | — |
| According to | I | 17.2 | 7.0 | 4.5 | 1.4 | 0.6 | 2.1 | — | — |
| the Present | J | 15.2 | 4.6 | 4.7 | 1.3 | 0.6 | — | 2.3 | — |
| Invention | K | 17.2 | 5.2 | 4.2 | 1.5 | 0.8 | — | — | 2.3 |
| | L | 15.5 | 4.6 | 4.3 | 1.2 | 0.8 | 1.8 | 2.2 | 2.2 |
| Contrast | d | 14.5 | 5.5 | 4.2 | 0.87 | — | — | — | — |
| Examples | e | 15.2 | 6.8 | 3.9 | 1.90 | — | — | — | — |
| | f | 15.7 | 7.9 | 4.2 | 0.66 | — | — | — | — |

TABLE 5

| | | 1. Cracks after Forging | 2. Hardness($H_B$) in an Air-Cooled State after Forging | 3. Hardness($H_B$) after T6 Treatment | 4. Hardness($H_B$) after 200° C. × 48 hours | 5. Hardness($H_B$) after 300° C. × 48 hours | 6. Density (g/cm³) |
|---|---|---|---|---|---|---|---|
| Examples | H | Non-Existence | 76 | 84 | 84 | 83 | — |
| According to | I | Non-Existence | 92 | 98 | 96 | 94 | — |
| the Present | J | Non-Existence | 68 | 102 | 94 | 88 | — |
| Invention | K | Non-Existence | 82 | 88 | 87 | 86 | 2.73 |
| | L | Non-Existence | 79 | 110 | 100 | 98 | 2.77 |
| Contrast | d | Non-Existence | 71 | 89 | 85 | 77 | 2.82 |

TABLE 5-continued

| | | 1. Cracks after Forging | 2. Hardness($H_B$) in an Air-Cooled State after Forging | 3. Hardness($H_B$) after T6 Treatment | 4. Hardness($H_B$) after 200° C. × 48 hours | 5. Hardness($H_B$) after 300° C. × 48 hours | 6. Density (g/cm³) |
|---|---|---|---|---|---|---|---|
| Examples | e | Existence | 85 | — | — | — | — |
| | f | Existence | 95 | — | — | — | — |

[Estimations for Test Results]

(1) As will be apparent from Table-4 and Table-5, in the case of alloys e and f (contrast examples), cracks are generated by the hot forging work, and so, satisfactory forge-shaped articles cannot be obtained.

(2) By comparing alloys d and H, it is seen that addition of Co is effective for improvement in deterioration of a hardness caused by high-temperature heating, and especially for improvement in deterioration of a hardness when the alloy is heated up to 300° C. (See columns 4 and 5 in Table-5).

(3) By comparing alloys H and I, it is seen that if Mn is added, forging work is possible without reducing Fe, and as a result, deterioration of a hardness caused by high-temperature heating can be avoided.

(4) By comparing alloys H and J, it is seen that if Zn is added, rise of a hardness especially in the case of heating up to 200° C. is remarkable.

(5) By comparing alloys d, K and L, it is seen that in the case of alloys K and L, deterioration of a hardness caused by high-temperature heating is little (See columns 4 and 5 in Table-5), and that Li has a function of lowering a density.

As will be obvious from the above description, heat-resisting high-strength aluminium alloy having good forging workability and a high strength, and a method for manufacturing a structural member made of said alloy have been proposed. According to the present invention, a high-temperature strength and a Young's modulus are enhanced by adding Fe and Si into Al, on the other hand the amount of Fe is suppressed as much as possible while achieving heat treatment reinforcement of an Al matrix by adding Cu and Mg, lowering of a high-temperature strength caused by suppression of the amount of Fe is compensated for by adding Co, hot forging workability is enhanced and stress corrosion cracking resistivity is improved by adding Mn, and also a high-strength structural member having good heat-resistivity and durability can be obtained by carrying out high-speed hot forging work.

In addition, although the Al-alloy according to the present invention is a high-strength material and so it can be hardly worked through the conventional shaping process in which shaping is effected by hot working of a cast raw material, a structural member made of sound heat-resisting high-strength sintered Al-alloy can be obtained through the steps of making powder at a predetermined cooling speed, press-shaping the powder so as to have a density ratio of 70% or higher, carrying out extrusion working at a temperature of 300°~400° C., and thereafter carrying out forging work at a temperature of 300°~495° C.

What is claimed is:

1. A method for manufacturing a structural member made of a heat-resisting, high-strength sintered Al-alloy comprising the steps of:

providing a molten Al-alloy consisting essentially of:

$8.0 \leqq Si \leqq 30$ wt.%, $2.0 \leqq Fe \leqq 33.0$ wt.%, $0.8 \leqq Cu \leqq 7.5$ wt.%, $0.3 \leqq Mg \leqq 3.5$ wt.%, and $0.5 \leqq Mn \leqq 5.0$ wt.% and/or $0.5 \leqq Co \leqq 3.0$ wt.%, the remaining being Al and inevitable impurities;

quenching and solidifying said molten Al-alloy at a cooling speed of $10^{3°}$ C./sec or higher to obtain an Al-alloy powder;

press-shaping said Al-alloy powder at a temperature of 350° C. or lower and at a shaping pressure of 1.5 to 5.0 ton/cm² to obtain a raw material for extrusion having a density ratio of 70% or higher;

extruding said raw material for extrusion at a temperature of 300° to 400° C. and at an extension ratio of 5 or higher to obtain a raw material for forging;

charging said raw material for forging into a metal mold that has been pre-heated to temperature of 150° C. to 450° C.;

forge-shaping said raw material for forging in said metal mold at a temperature of 300° to 495° C. to obtain a forge-shaped body; and cooling the forge-shaped body.

2. A structural member made from heat-resistant, high-strength Al-alloy, said structural member being prepared by a process comprising the steps of:

providing a molten Al-alloy consisting essentially of:

$8.0 \leqq Si \leqq 30$ wt.%, $2.0 \leqq Fe \leqq 33.0$ wt.%, $0.8 \leqq Cu \leqq 7.5$ wt.%, $0.3 \leqq Mg \leqq 3.5$ wt.%, and $0.5 \leqq Mn \leqq 5.0$ wt.% and/or $0.5 \leqq Co \leqq 3.0$ wt.%, the remaining being Al and inevitable impurities;

quenching and solidifying said molten Al-alloy at a cooling speed of $10^{3°}$ C./sec or higher to obtain an Al-alloy powder;

press-shaping said Al-alloy powder at a temperature of 350° C. or lower and at a shaping pressure of 1.5 to 5.0 ton/cm² to obtain a raw material for extrusion having a density ratio of 70% or higher;

extruding said raw material for extrusion at a temperature of 300° to 400° C. and at an extrusion ratio at 5 or higher to obtain a raw material for forging;

charging said raw material for forging into a metal mold that has been pre-heated to temperature of 150° C. to 450° C.;

forge-shaping said raw material for forging in said metal mold at a temperature of 300° to 495° C. to obtain a forge-shaped body; and cooling the forge-shaped body.

3. A method for manufacturing a structural member made of a heat-resisting, high-strength sintered Al-alloy as claimed in claim 1 wherein intermetallic compounds contained in said Al-alloy powder have a size of 10 μm or less.

4. A method for manufacturing a structural member made of heat-resisting high-strength sintered Al-alloy as claimed in claim 1, in which said structural member is a connecting rod.

5. A method for manufacturing a structural member made of heat-resisting high-strength sintered Al-alloy as claimed in claim 1, in which said structural member is a piston.

* * * * *